United States Patent [19]

Harvey

[11] 3,994,227

[45] Nov. 30, 1976

[54] BOUNDING ANTI-PERSONNEL MINE

[75] Inventor: Wallace J. Harvey, Succasunna, N.J.

[73] Assignee: The United States of America as represented by the Secretary of the Army, Washington, D.C.

[22] Filed: Oct. 6, 1971

[21] Appl. No.: 187,134

[52] U.S. Cl. ..... 102/8; 102/76 R
[51] Int. Cl.[2] ..... F42B 23/16; F42B 23/26
[58] Field of Search ..... 102/8, 7.2, 2, 76

[56] References Cited

UNITED STATES PATENTS

| | | | |
|---|---|---|---|
| 2,440,702 | 5/1948 | Short | 102/8 |
| 3,175,489 | 3/1965 | Reed, Jr. | 102/8 |
| 3,344,742 | 10/1967 | Schneider, Jr. | 102/8 X |
| 3,434,418 | 3/1969 | Madlener et al. | 102/8 |
| 3,575,110 | 3/1971 | Conroy et al. | 102/8 |

*Primary Examiner*—David H. Brown
*Attorney, Agent, or Firm*—Nathan Edelberg; A. Victor Erkkila

[57] ABSTRACT

A mine casing containing an ejection barrel is closed by a shear releasable, slidable and rotatable cover for providing an armed and a safe position. The barrel is rotatably coupled to the cover and carries a slidable belleville spring assembly including a belleville spring containing a firing pin which rests on the base of the casing and is aligned with a primer communicating with a delay column. An apertured safety plate rotatably coupled to the barrel is positioned between the delay column and ejection propellant communicating with a recess in a fragmentation sphere containing a high explosive nesting in the upper contoured portion of the barrel. The recess contains an ignition delay and a booster charge for detonating the high explosive. In the safe position the barrel cannot move downwardly and the safety plate prevents communication between the delay and propellant. When the mine cover is rotated into the armed position, the safety plate is turned to a position permitting communication between the delay column and propellant, and the barrel can be moved downward by pressure on the cover or by rotation of a ball cam in the cover in contact with the sphere. The downward movement of the barrel snaps the spring and drives the firing pins into the primer, igniting the delay and propellant, which generates gas pressure to launch the sphere, remove the cover and activate the ignition delay and booster so that the sphere is detonated sometime after launching.

10 Claims, 2 Drawing Figures

INVENTOR.
WALLACE J. HARVEY
BY Harry M. Saragovitz, Edward J. Kelly, Herbert Berl
Ernest J. Weinberger

INVENTOR.
WALLACE J. HARVEY

BY Harry M. Saragovitz, Edward J. Kelly, Herbert Berl
Ernest J. Wenderger

BOUNDING ANTI-PERSONNEL MINE

The invention described herein may be manufactured, used and licensed by or for the Government for governmental purposes without the payment to me of any royalty thereon.

BACKGROUND OF THE INVENTION

The present invention relates to mines and more particularly pertains to bounding anti-personnel mines wherein the mine is provided with a safe position or condition which includes a plurality of separate physical safety structures with at least two methods of activation.

In the field of anti-personnel land mines, it has been the general practice to employ mines of the type wherein the safety features and methods of activation are limited. Such devices have not proved to be entirely satisfactory and the present invention fills this need while overcoming the inherent limitations.

SUMMARY OF THE INVENTION

The general purpose of this invention is to provide a bounding anti-personnel land mine that has all the advantages of similarly employed prior art devices and has none of the above described disadvantages. To attain this, the present invention provides a unique structural mine arrangement wherein the mine is capable of assuming both an armed and a safe condition under the rotatable action of the cover while being detonable in the armed condition by application of a downward force on the internal barrel through either the mine cover or by a lever operating a ball cam. The dual positions are attained by the detented rotation of the cover which is coupled to the barrel and all the internal parts rotate therewith except the belleville spring housing. In the safe position the barrel skirt abuts the partial shoulder formed in the base of the housing thus preventing movement of the barrel and at the same time interposing a safety plate between the delay column and the propellant charge, providing a delay column vent and locking the safety plug to the ejectionable high explosive fragmentation sphere. In the armed position the communication between the various portions of the explosive and propellant train is made while the vent opening is blocked.

An object of the present invention is to provide a reliable, safe, efficient, relatively inexpensive and small anti-personnel land mine, which may be activated in several ways.

Another object is the provision in a land mine which is activated by both pressure or a trip wire and which includes a delay mechanism that permits a short time period after initiation for detonation to allow the personnel activating the mine to move thereoff.

Still another object is to provide an anti-personnel bounding mine that includes a plurality of independent safety arrangements which are selectably operable externally of the mine.

Other objects and many of the attendant advantages of this invention will be readily appreciated as the same becomes better understood by reference to the following detailed description when considered in connection with the accompanying drawings.

DESCRIPTION OF A PREFERRED EMBODIMENT

Figure 1:
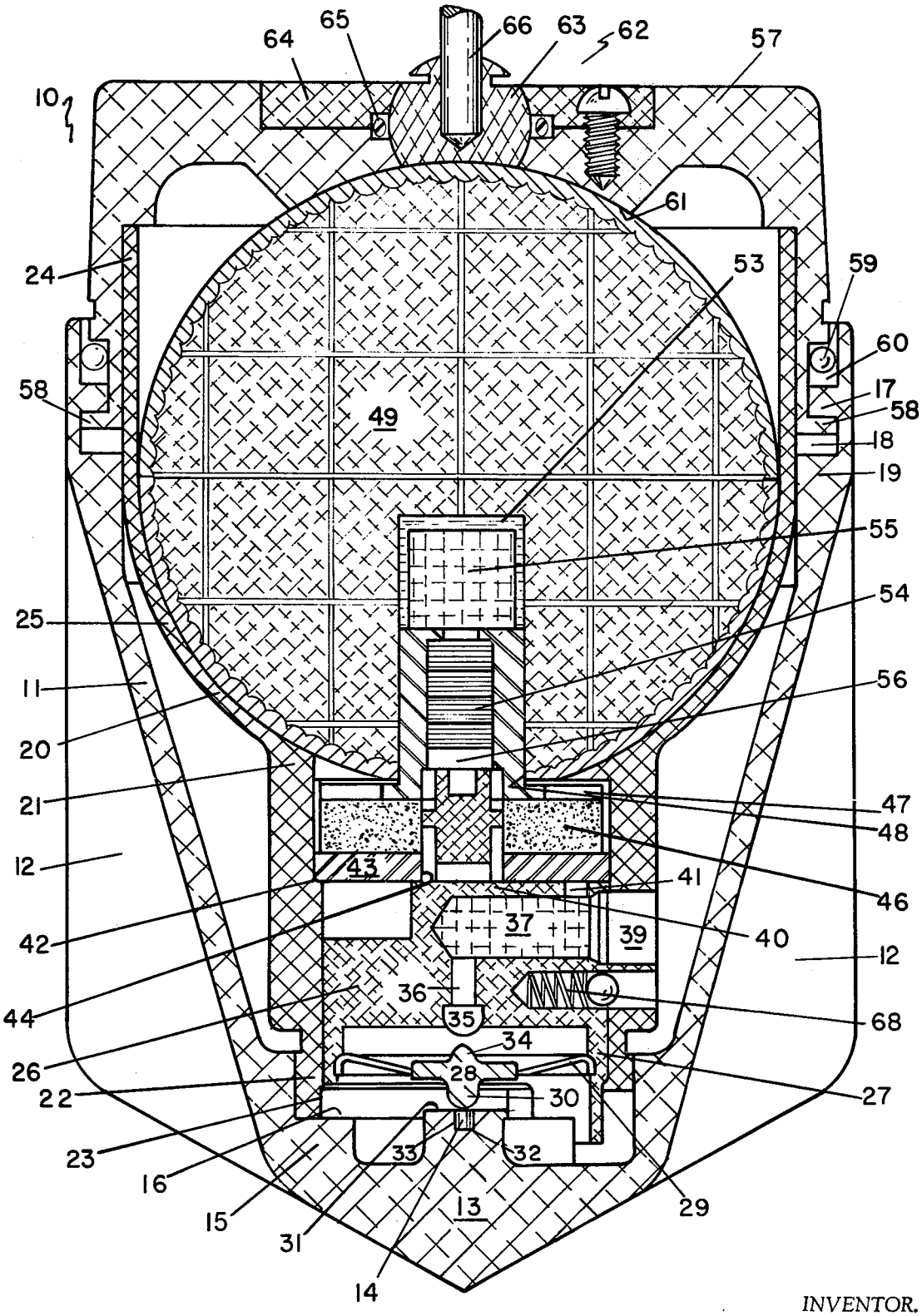
FIG. 1 is a cross-sectional view of an embodiment made in accordance with the principle of this invention wherein the device is in the safe position; and, FIG. 2 is the device of FIG. 1 illustrated in the armed position.

In the illustrated embodiment of FIG. 1 the bounding anti-personnel mine 10 includes a hollow body or casing 11 which is provided with a plurality of laterally extending ribs 12 and is open at one end while the opposite end 13 converges with the interior thereof being formed with a centered raised boss 14 and a partial annular elevated portion 15 forming an upwardly directed shoulder 16. The upper inner wall of the body is provided with an inwardly directed annular flange 17 so as to form a recess 18 between it and the enlarged section 19. Seated within the body 11 is ejection barrel 20 which is generally cylindrical and consists of three portions a lower housing end 21 which terminates in an annular skirt 22 whose outer surface tightly abuts the inner body wall to provide releasable support therefor. The skirt is shortened over a portion thereof and elongated at separate opposed portions as at 23 which form depending flanges that rest on the body shoulder 16 in the safe position thereby restricting any movement of the barrel. The upper portion 24 is cylindrical and constitutes the actual barrel with the spherical portion 25 joining the upper and lower portions. Slidingly disposed within the lower portion of the ejection barrel 20 is the cylindrical belleville housing assembly 26 between whose lower skirt 27 is supported firing pin 28 via the belleville spring 29 which is fixed to the skirt. In the safe position the base 30 of the spring rests against the upper face 31 of boss 14 while the guide pin 32 of the firing pin is within the guide hole 33 without resting therein. Supported directly in line with the operating end 34 of the firing pin 28 is the percussion primer 35 whose opposite end is aligned with the central primer flash hole 36 and communicates directly with the cavity 37 filled with a delay composition 38. The wall of the ejection barrel is provided with a vent opening 39 that aligns with this filled cavity when the mine is in the safe position so as to safely vent the delay should it be accidentally activated. The upper wall 40 of the belleville assembly is formed with a flash opening 41 contacting the delay cavity. Supported and press-fit in for rotation therewith directly above the belleville assembly by an annular shoulder 42 formed in the wall of the barrel, is a safety plate 43 having a central aperture 44 and a transverse hole 45 (see FIG. 2) which is out-of-line with the flash opening 41 in the safe position. In contact with and directly above the safety plate 43 is a propellant charge assembly 46 which fits within the piston cup or obturator 47 that in turn is crimped to the walls formed by the opening 48 of hollow fragmentation sphere 49. This internally embossed fragmentation ball is capable of producing uniform fragments of controlled size and weight. The disc-like charge assembly 46 is provided with a downward partial recess 50 (see FIG. 2) which is aligned with an upward facing recess 51 in plate 43 and has confined therein a pin 52 for insuring coacting rotary movement of these parts.

The hollow embossed fragmentation sphere 49 rests within the contoured portion of the barrel and is filled with a high explosive that is centrally recessed at 53 in-line with the obturator and has disposed therein a delay-relay element 54 and a tetryl booster 55. Disposed within the central aperture of the propellant charge assembly and the safety plate is a safety plug 56 that is mounted with a helical bayonet lock so that in the safe position it is locked to the sphere across the obturator opening and on turning of the barrel it will descend into the lower housing. With the sphere and the lower assemblies resting within the barrel, the upper portion of the sphere extends beyond the upper edge of both the body and the barrel and the barrel and the opening across both is closed by rotatable cover 57. The cover is formed with a pair of partially annular shear lips 58 which engage segmented flange 17 of the body so as to rotatably lock the cover on to the body while the interposed "O" ring 59 seals the two members within the formed annular recess 60. The lower or inner central cover surface 61 is contoured to abut the upper portion of the sphere so that as the cover is depressed, with the shear lip moving down within the elongated annular recess 18, the contoured surface bears against the sphere and causes it to move downwardly when the barrel is in the armed position. The cover is provided with a central cutout 62 in which is supported for pivotal movement, a ball cam 63 having a lower surface conforming to and abutting the sphere. The cam is positioned and confined within the retainer plate 64 and rotatably sealed therein by O ring 65. Radially fixed to and extending outwardly of the cam is a trip lever 66 whose deflection in any direction rotates the cam and thereby provides a downward amming action between the outer surface of the fragmentation sphere and the spherical surface of the cam. Such tripping action may be caused by deflection of a trip wire extending from said lever.

Figure 2:
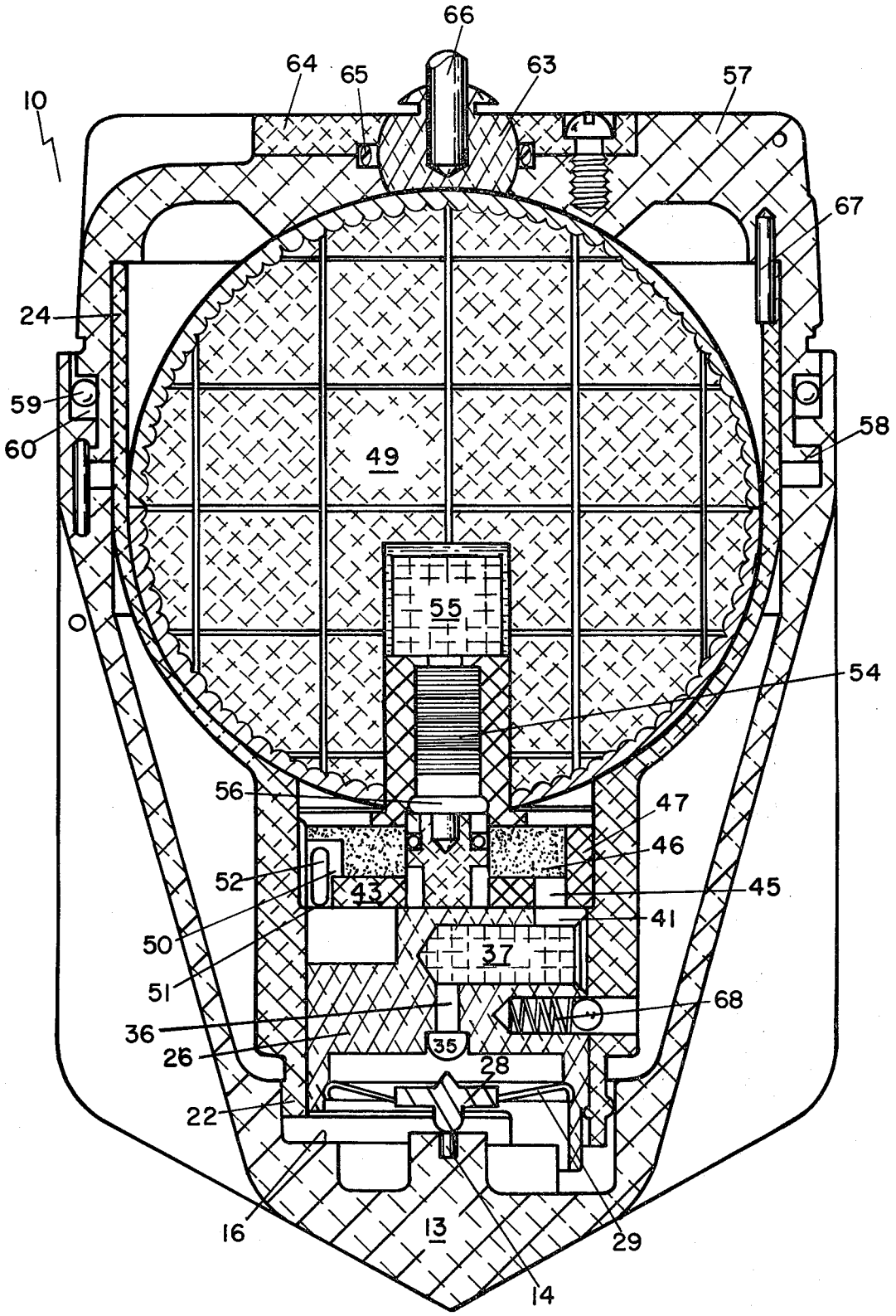

Referring now to FIG. 2 wherein the mine is illustrated in the armed position, it is clear that the cover 57 has two basic degrees of freedom, namely, rotary and linear toward the sphere (when armed). Stop pin 67 couples the rotary motion of the cover to the ejection barrel, which in the armed position, permits depression thereof. Thus by rotating the cover from the safe position of FIG. 1 to that of FIG. 2, the barrel is rotated so that the shortened portion of the skirt 22 is opposite the shoulder 16 and the barrel is capable of downward movement. The belleville spring assembly is not coupled to the barrel and therefore does not rotate. Its only contact to the barrel is via ball detent assembly 68 that fixes the multiple rotary positioning of the cover. Rotation of the cover into the armed position results in repositioning of the safety plate so that the flash hole 45 thereof and opening 41 in the belleville spring assembly are aligned and form a communicating passageway between the delay column 37 and the propellant charge 45. At the same time the safety plug 56 descends and the vent opening 39 in the barrel rotates away from the delay column 37.

Activation of the mine occurs upon application of pressure to the mine cover or by deflection of the trip lever through a trip wire strung in any direction from the lever when the ejection barrel is forced downwardly the belleville spring peripheral edge descends with the skirt and, since the firing pin 28 is limited in its downward travel, the spring 29 inverts or snaps and drives the firing pin 28 upwardly into the percussion primer 35. Its path is directed by the guide pin 32 so that it must contact the primer which ignites the delay column 37 via the flash hole 36. This delay is inserted to insure that sufficient time passes in order to permit the activating cover pressure to be relieved or in the instance of personnel, that the person's foot is off the cover. After this short delay the column 37 through the opening 45 in the safety plate 43 ignites the ejection charge of mortar propellant 46. The propellant in turn ignites the delay-relay element 54 which is assembled within the fragmentation sphere. During this period, the propellant generated gas pressure expands the thin walled metallic obturator 47 and forces the fragmentation sphere upwardly against the mine cover 57. Upon the generation of sufficient internal pressure the cover lips 58 are sheared and the sphere is upwardly ejected from the barrel. The lips are materially and structurally fabricated to shear at the proper pressure and are similar in shape to the lips on the gasoline caps of automobiles. When the sphere attains a sufficient height about ground the delay-relay ignites the booster 55 which thereupon detonates the high explosive composition B charge within the embossed fragmentation sphere 49.

It should be understood, of course, that the foregoing disclosure relates to only a preferred embodiment of the invention and that numerous modifications or alterations may be made therein without departing from the spirit and the scope of the invention as set forth in the appended claims.

I claim:

1. A bounding land mine capable of assuming a safe and an armed position which comprises:

a hollow body open at one end and having disposed therein, a rotatable ejection barrel, means for selectively limiting the downward travel of said barrel, said barrel having disposed therein, a belleville spring assembly which includes, a firing pin centrally supported proximate the base of said body by, a belleville spring, a primer means disposed in the path of said firing pin, a safety plate rotatable with said barrel disposed above said spring assembly and provided with a passageway therethrough communicating with said primer means in one rotary position of said barrel, a propellant charge disposed above said safety plate, a high explosive fragmentary member releasably supported in said barrel and provided with a depending obturator means enclosing said propellant charge, a rotatable cover closing said body provided with pressure release means abutting and coupled for rotation with said barrel and in abutting relation with said fragmentary member, whereby when said cover is depressed in said one rotary position said barrel will travel toward said base flexing and snapping said spring thereby driving said firing pin into said primer means in turn detonating said propellant and ejecting said fragmentary member.

2. The mine according to claim 1 wherein said means for selectively limiting includes a skirt formed in the lower portion of said barrel having a plurality of separate depending flanges which coact with a raised inner partial shoulder formed in said body.

3. The mine according to claim 2 wherein said base of said body is provided with an inner upstanding central boss having an opening for receiving a guide carried by said firing pin.

4. The mine according to claim 3 wherein said spring assembly further includes a delay column and is formed with a flash hole between said primer means and said column and a detent means for indexing said positions.

5. The mine according to claim 4 wherein said barrel wall is formed with a vent opening opposite said column when said barrel is in another of said positions.

6. The mine according to claim 5 wherein said pressure release means include coacting shear lips carried by said cover and engaging within a recess formed in said body.

7. The mine according to claim 5 further including cam means carried by said cover engaging said fragmentary member for cammingly depressing said member and said barrel for activation of said mine.

8. The mine according to claim 7 further including a safety plug capable of assuming one of two physical positions dependent on the rotational displacement of said cover and barrel, one of said plug positions being fixed across the opening of said obturator when said barrel is in said one position.

9. The mine according to claim 8 wherein said cam is partially spherical, is seated for pivotal movement in said cover, and is provided with a radially extending trip lever.

10. The mine according to claim 9 wherein said fragmentary member is spherical, hollow and filled with high explosive and said barrel is contoured to receive and seat said fragmentary spherical member.

* * * * *